US007380495B1

(12) United States Patent
Wang

(10) Patent No.: US 7,380,495 B1
(45) Date of Patent: Jun. 3, 2008

(54) STRAP FEEDING AND WITHDRAWING STRUCTURE FOR A PACKING MACHINE

(75) Inventor: Hermes Wang, Taiping (TW)

(73) Assignee: Jangzin Industrial Co., Ltd., Taichung County (TW)

( * ) Notice: Subject to any disclaimer, the term of this patent is extended or adjusted under 35 U.S.C. 154(b) by 0 days.

(21) Appl. No.: 11/943,563

(22) Filed: Nov. 20, 2007

(51) Int. Cl.
*B65B 13/22* (2006.01)

(52) U.S. Cl. ..... 100/32; 100/4; 100/29; 53/589

(58) Field of Classification Search ..... 100/4, 100/29, 30, 32, 33 R, 33 PB; 53/582, 589; 140/93.2, 93.4
See application file for complete search history.

(56) References Cited

U.S. PATENT DOCUMENTS 5,379,576 A * 1/1995 Koyama ..... 53/589
5,509,594 A * 4/1996 Maggioni ..... 226/35
6,463,848 B1 * 10/2002 Haberstroh et al. ..... 100/32
7,165,379 B1 * 1/2007 Lai ..... 53/589

* cited by examiner

*Primary Examiner*—Jimmy T Nguyen
(74) *Attorney, Agent, or Firm*—Ming Chow; Sinorica, LLC

(57) ABSTRACT

A strap feeding and withdrawing structure for a packing machine includes a driving member and a strapping member pivotally assembled on a main body of a conveying device and respectively driven by an electromagnetic switch unit and a pull member to carry out strap feeding, strap withdrawing and strap strapping work. The separable strap feeding and withdrawing structure of this invention can be disassembled quickly, facilitating maintenance and removal of disorder. In addition, the strapping member is disposed thereon with a strap withdrawal detecting member able to accurately control data of strap withdrawing and tightness of strapping.

6 Claims, 6 Drawing Sheets

STRAP FEEDING AND WITHDRAWING STRUCTURE FOR A PACKING MACHINE

BACKGROUND OF THE INVENTION

1. Field of the Invention

This invention relates to a packing machine, particularly to one provided with a strap feeding and withdrawing structure able to carry out strap packing accurately and be disassembled quickly for facilitating maintenance and repair.

2. Description of the Prior Art

A conventional packing machine 10, as shown in FIG. 1, is provided with a strap feeding and withdrawing mechanism 12 in a machine table 11 for controlling feeding and withdrawing of the strap in the interior of the packing machine 10. The strap feeding and withdrawing mechanism 12 is composed of a bracket 121, a strap-feeding wheel unit 122, a strap guiding wheel unit 123 and a strap-withdrawing wheel unit 124. The bracket 121 is secured inside the machine table 11, and the strap-feeding wheel unit 122, the strap-guiding wheel unit 123 and the strap-withdrawing wheel unit 124 are firmly assembled on the bracket 121. The foresaid mechanism can function to carry out strap feeding and withdrawing, but the whole strap feeding and withdrawing mechanism 12 has to be disassembled when it needs to be repaired or replaced, resulting in trouble in maintenance and assembly, and replacing cost may be high.

SUMMARY OF THE INVENTION

The objective of this invention is to offer a strap feeding and withdrawing structure for a packing machine, which includes a conveying device and a packing device. The conveying device consists of a main body, a driving member, a strapping member, an electromagnetic switch unit, a pull member and a strap withdrawal detecting member. The main body has one side assembled with a driving wheel and a strapping wheel, and a combining member transversely fixed between the driving wheel and the strapping wheel. The driving member is pivotally provided thereon with an auxiliary driving wheel, having one side movably and pivotally combined with the combining member of the main body and another side, which is distant from the combining member, fixed with a fastening portion. The strapping member is pivotally disposed with an auxiliary strapping wheel, having one side movably and pivotally connected with the combining member of the main body. The electromagnetic switch unit is composed of an electromagnetic valve and a connecting rod set. The strap withdrawal detecting member is able to detect rotating conditions of the auxiliary driving wheel of the driving member. The electromagnetic switch unit is operated to carry out strap feeding and withdrawing, and the pull member is driven to do strapping work and the strap withdrawal detecting member functions to detect the action of the auxiliary driving wheel of the driving member. When the auxiliary driving wheel stops operating, the strap withdrawal detecting member will output a signal to notify the strapping wheel to begin carrying out strap-tightening work. By so designing, the packing machine of this invention can carry out strap packing accurately. In addition, the components of the conveying device are pivotally assembled together so they are easy to be disassembled for facilitating maintenance and repair.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
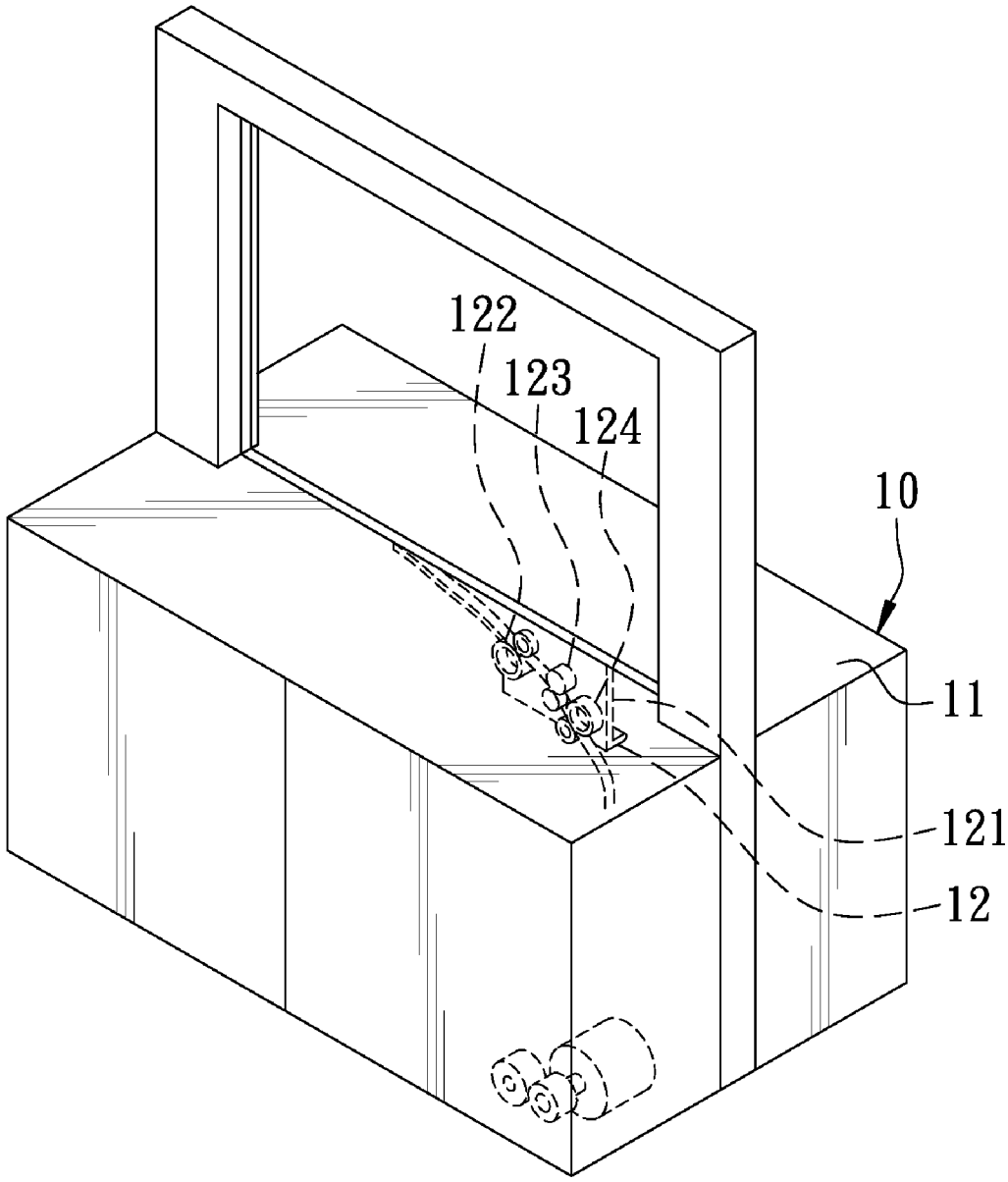
FIG. 1 PRIOR ART
FIG. 1 is a perspective view of a conventional packing machine.
Figure 2:
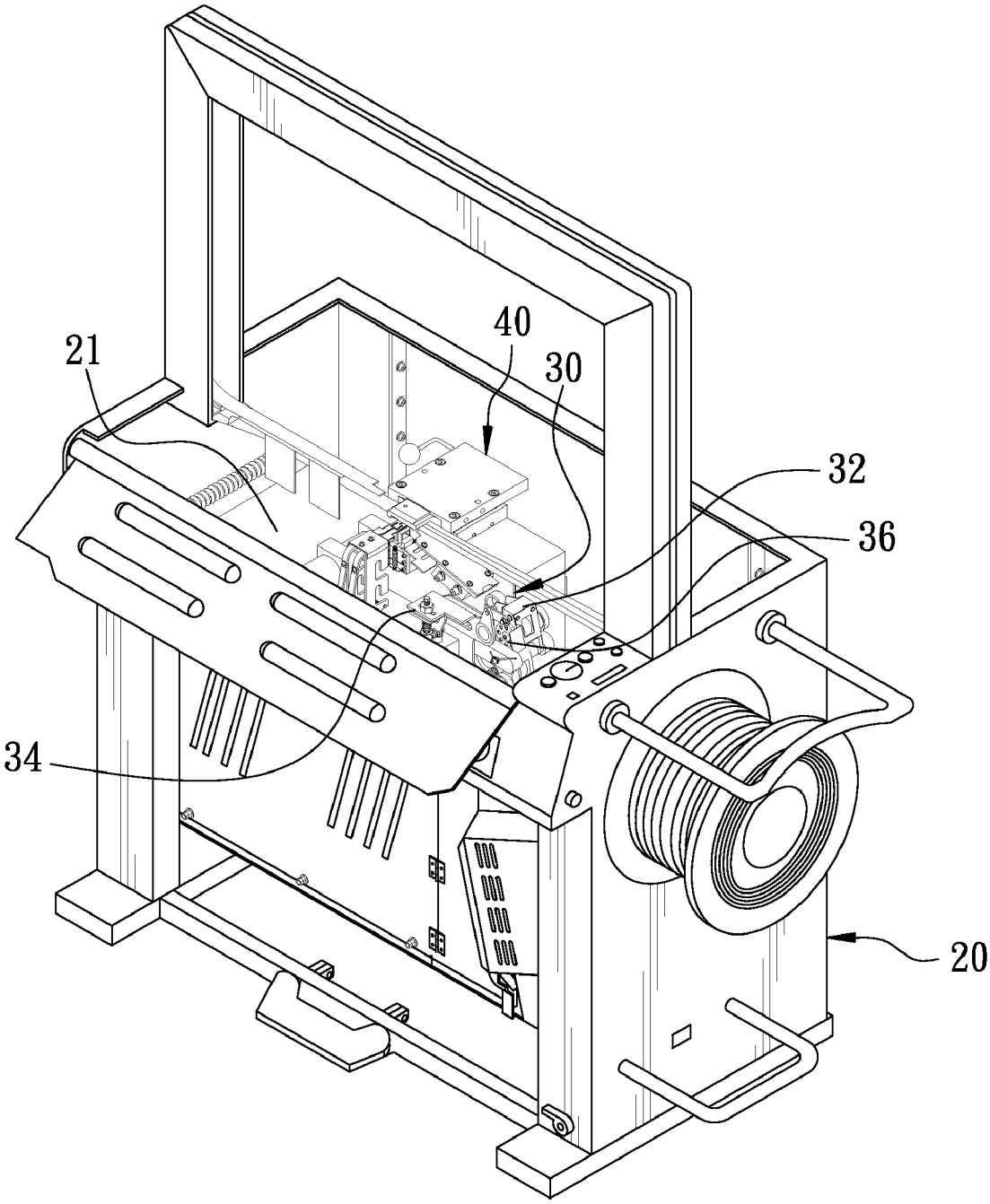
FIG. 2 is a perspective view of a strap feeding and withdrawing structure for a packing machine in the present invention.
Figure 3:
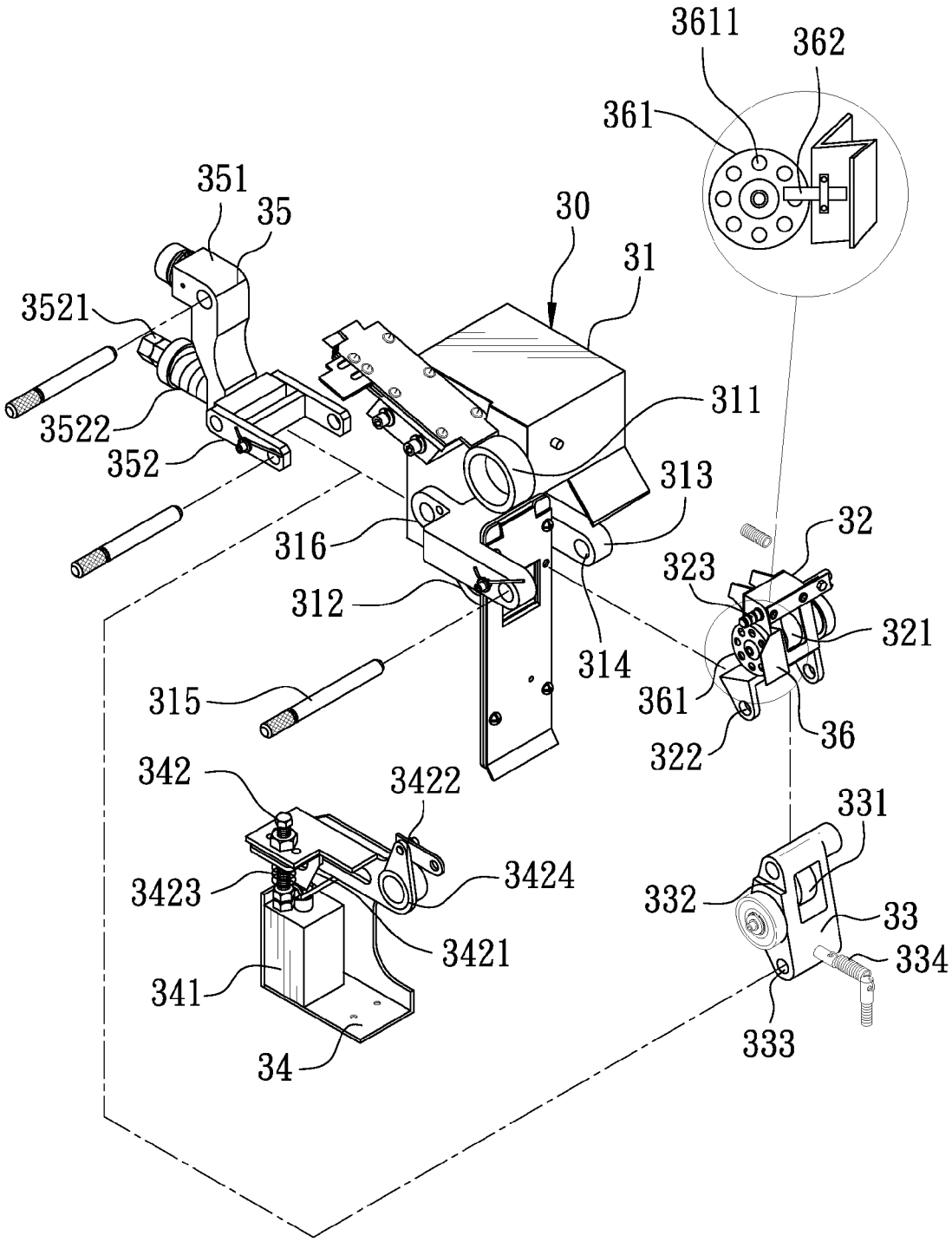
FIG. 3 is an exploded perspective view of a conveying device of the strap feeding and withdrawing structure for a packing machine in the present invention.
Figure 4:
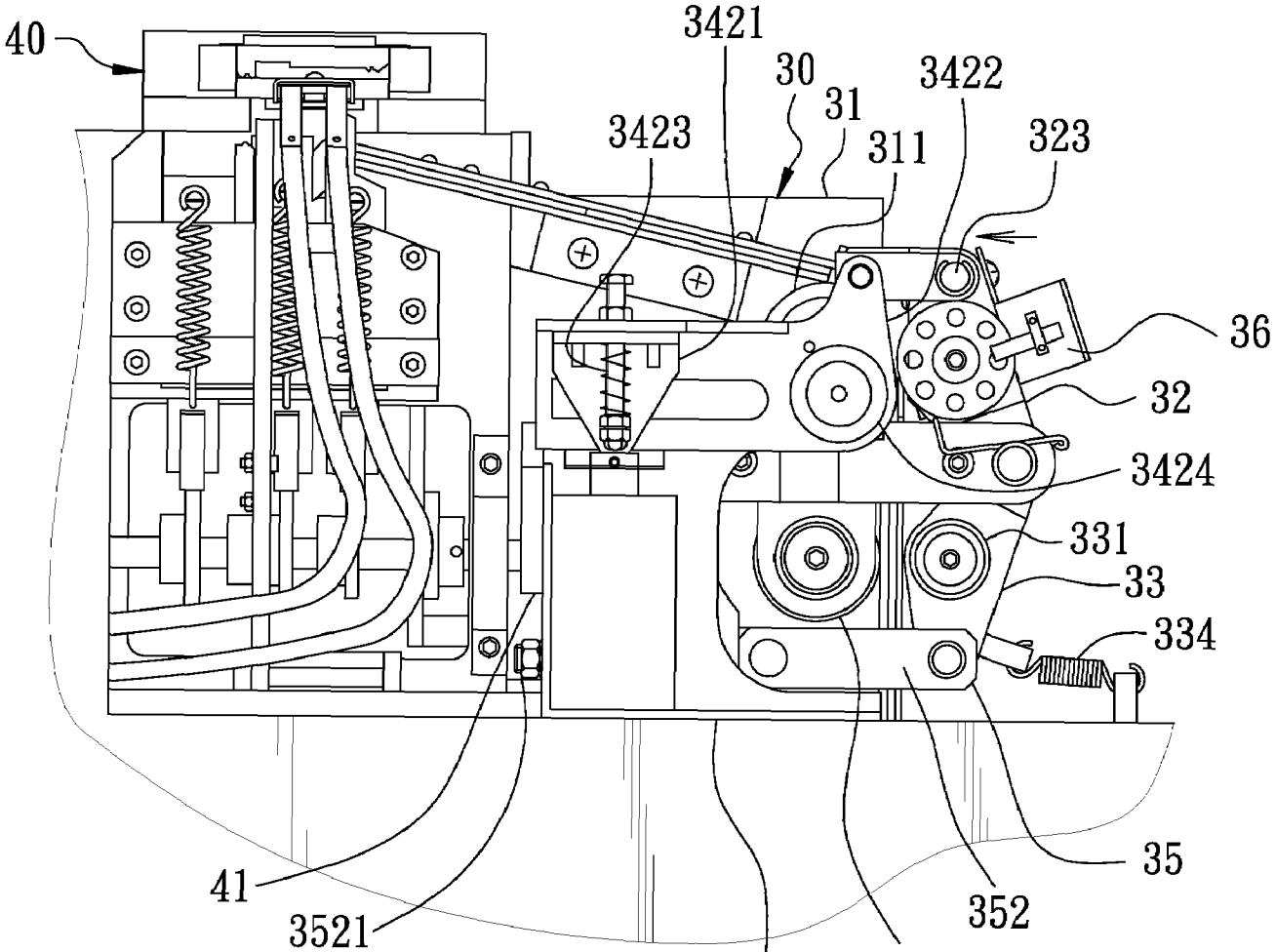
FIG. 4 is a cross-sectional view of the conveying device in a strap feeding and withdrawing condition in the present invention.
Figure 5:
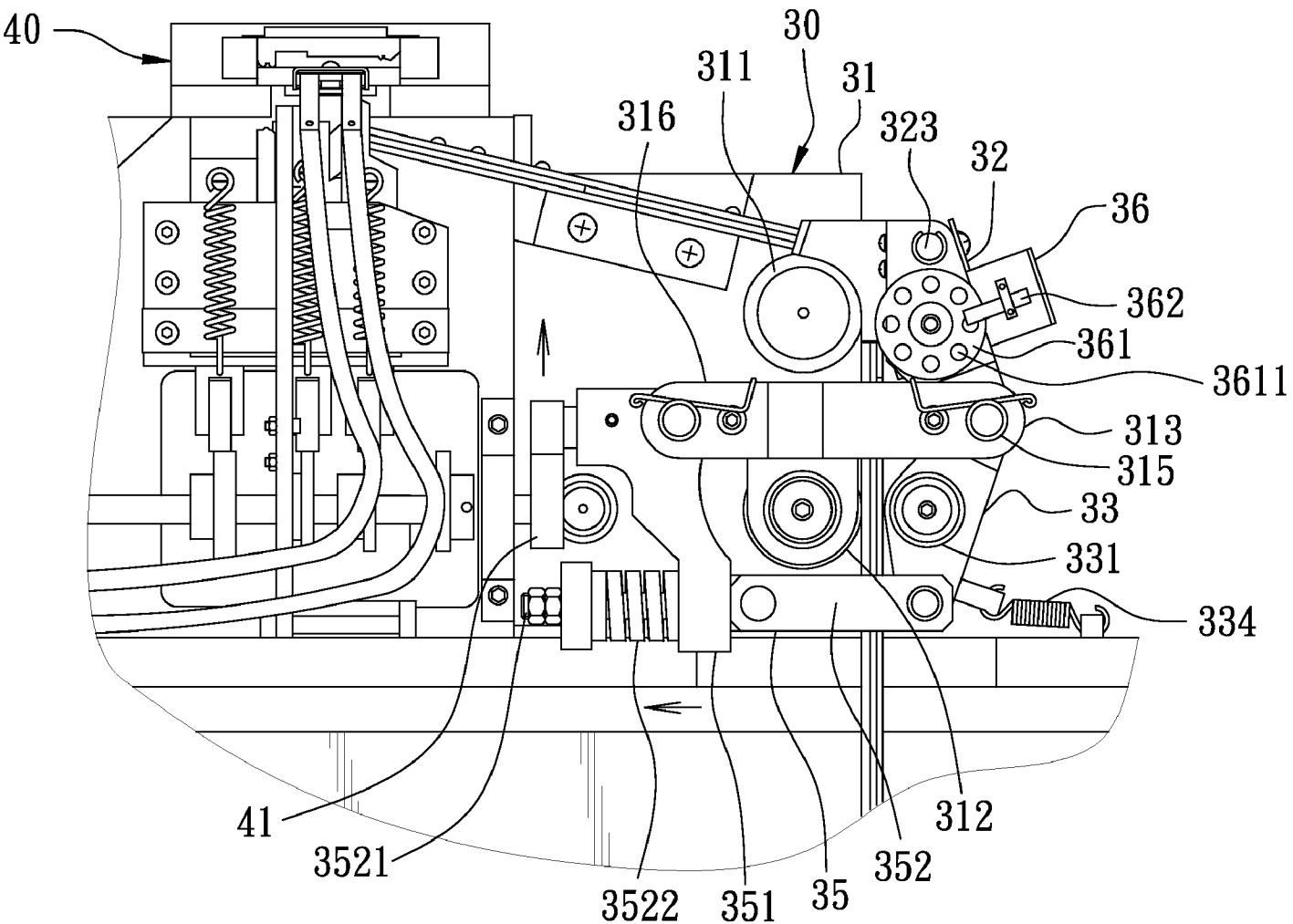
FIG. 5 is a cross-sectional view of the conveying device in a strapping condition in the present invention.
Figure 6:
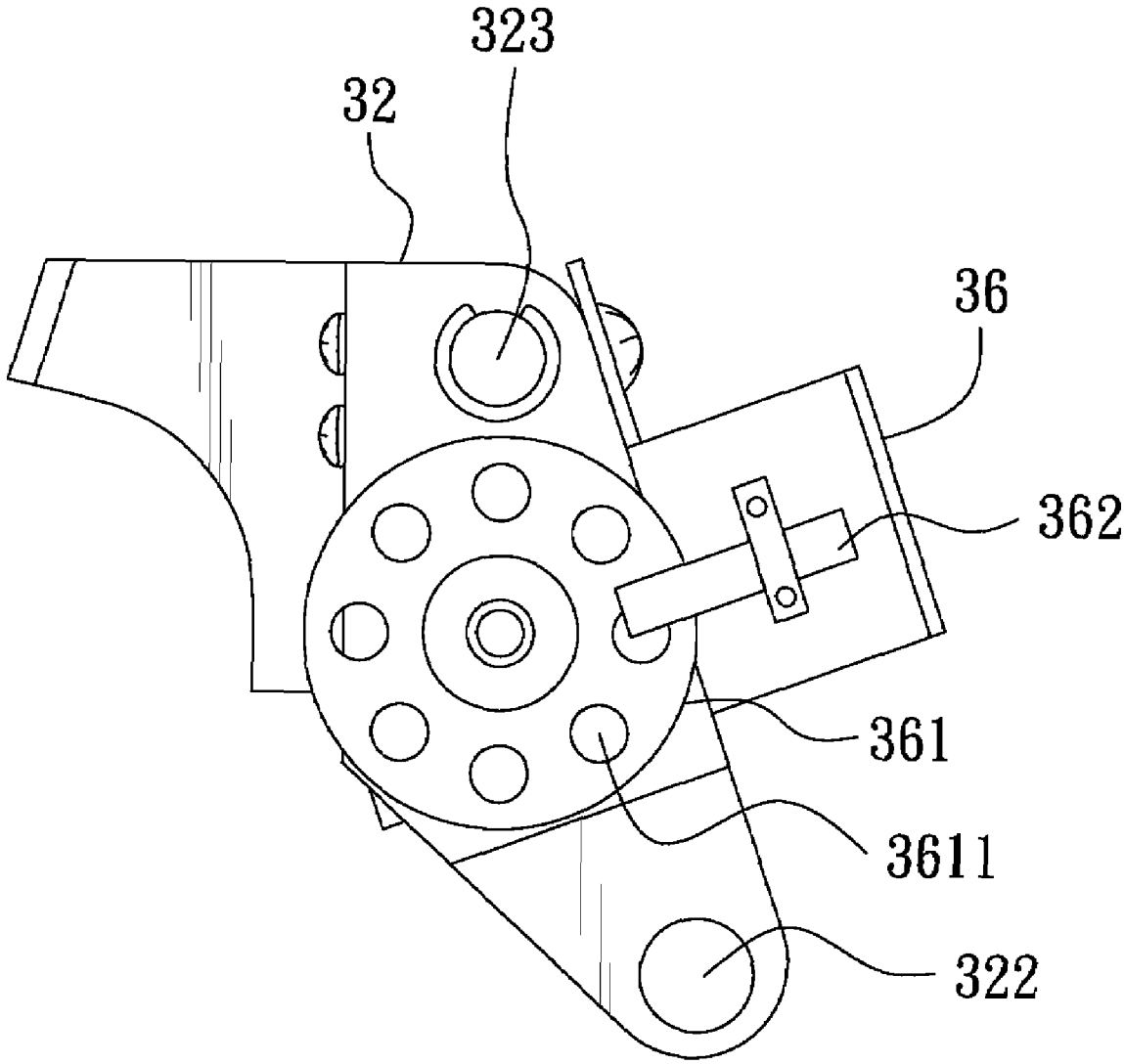
FIG. 6 is a cross-sectional view of a sensor unit of the strap feeding and withdrawing structure for a packing machine in the present invention.

A preferred embodiment of a strap feeding and withdrawing structure for a packing machine in the present invention, as shown in FIGS. 2 to 6, includes a conveying device 30 and a packing device 40 assembled on a foundation plate 21 of a packing machine 20.

The conveying device 30 consists of a main body 31, a driving member 32, a strapping member 33, an electromagnetic switch unit 34, a pull member 35 and a strap withdrawal detecting mechanism 36 combined together.

The main body 31 has a driving wheel 311 and a strapping wheel 312 assembled at one side, and a U-shaped combining member 313 transversely disposed between the driving wheel 311 and the strapping wheel 312 and having two free ends respectively bored with an insert hole 314 for a pivot 315 to be inserted therethrough. The combining member 313 has its rear side extended backward to form an extension portion 316.

The driving member 32 is pivotally provided thereon with an auxiliary driving wheel 321 to be rotated together with the driving wheel 311 of the main body 31, having its underside bored with a lower insert hole 322 to be movably and pivotally fitted on the pivot 315 and its topside provided with a protuberant fastening portion 323.

The strapping member 33 is pivotally mounted with an auxiliary strapping wheel 331 to be rotated together with the strapping wheel 312 of the main body 31, having its topside bored with an upper lateral insert hole 332 to be pivotally fitted with the pivot 315 and its lower side formed with an interacting portion 333. An auxiliary elastic element 334 is positioned between one outer side of the strapping member 33 and the foundation plate 21.

The electromagnetic switch unit 34 is composed of an electromagnetic valve 341 and a connecting rod set 342 consisting of a lower clamping plate 3421, an upper clamping plate 3422 and an elastic element 3423. The lower clamping plate 3421 is pivotally assembled on the electromagnetic valve 241, and the upper clamping plate 3422 has one end pivotally fixed on the fastening portion 323 of the driving member 32, having a shaft 3424 pivotally connected thereon so that the connecting rod set 342, with the shaft 3424 acting as a pivot, can be turned around. Further, the upper clamping plate 3422 has one end, distant from the fastening member 323, pivotally and elastically combined with the lower clamping plate 3421 by means of the elastic element 3423.

The pull member 35 is composed of a connecting rod 351 and a pawl 352. The connecting rod 351 is pivotally combined with the extension member 316 of the main body 31, able to be turned for a preset angle. The pawl 352 has its rear end extended backward and formed with an extension rod 3521 pivotally inserted in the lower end of the connecting rod 351 and fitted thereon with an elastic element 3522 to enable the pawl 352 to be elastically and pivotally positioned. The pawl 352 has its free ends pivotally combined with the interacting portion 333 of the strapping member 33.

The strap-withdrawal detecting member 36 is secured on one outer side of the driving member 32, consisting of a light disk 361 and a light sensor 362. The light disk 361 has its circumference bored with a plurality of light apertures 3611 preset is number, able to be rotated together with the auxiliary driving wheel 321 of the driving member 32. A signal output by the light sensor 362 will pass through the light disk 361 and vary with different locations of the light apertures 3611. When the light disk 361 is slowed down in rotation, the strap-withdrawal detecting member 36 will produce a signal to actuate the strapping wheel 312 to begin strap tightening work.

The packing device 40 positioned adjacent to the conveying device 30 is provided with an actuating cam 41 for driving the connecting rod 351 of the pull member 35 to operate.

Next, in using, referring to FIGS. 2 to 6, when the conveying device 30 is to convey a strap, the electromagnetic switch unit 34 is to be turned on first to let the electromagnetic valve 341 pull the lower clamping plate 3421 downward, and simultaneously the upper clamping plate 3422, with the shaft 3424 acting as a pivot, will be actuated to turn and move the driving member 32 closer to the main body 31 to shorten the space between the driving wheel 311 of the main body 31 and the auxiliary driving wheel 321 of the driving member 32. At this time, the driving wheel 311 is driven by a motor (not shown) to rotate counterclockwise and convey the strap, and during carrying out packing, the driving wheel 311 will be driven by the motor to rotate clockwise and tighten the strap. After finishing tightening the packing strap, the auxiliary driving wheel 321 will be actuated to rotate at slow speed, and simultaneously the light disk 361 will relatively be rotated slowly. When the light sensor 362 detects that the signal of the light disk 361 has been unchanged for a fixed period of time, it indicates that the strap is finished in surrounding an object, and at this time, the light sensor 362 will send out a signal for carrying out strap tightening work. The strap withdrawal detecting mechanism 36 enables the packing machine to desirably and properly perform strap withdrawing for different-sized articles. During doing strap tightening work, the electromagnetic valve 341 is turned off, and the connecting rod set 342 will recover its original position. Subsequently, the actuating cam 41 of the packing device 40 will be rotated to drive the connecting rod 351 of the pull member 35 to move the pawl 352, which then moves the strapping member 33 closer to the main body 31 to shorten the space between the auxiliary strapping wheel 331 of the strapping member 33 and the strapping wheel 312 of the main body 31. So the strapping wheel 312 is driven to carry out strap tightening work by a motor (not shown).

After the conveying device 30 is used for a period of time and necessary to remove disorder or carry out examining and repairing, the driving member 32 and the strapping member 33 pivotally assembled on the main body 31 can easily be disassembled from the main body 31, and the electromagnetic switch unit 34 and the pull member 35, which are respectively and pivotally connected with the driving member 32 and the strapping member 33, can also easily be disassembled for repairing. In addition, when a machine part needs to be replaced with a new one, it is only necessary to replace a damaged part, greatly lowering maintenance cost.

Further, the elastic element 3423 positioned between the upper clamping plate 3422 and the lower clamping plate 3421 on the connecting rod set 342 of the electromagnetic switch unit 34 can function to adjust a force for pulling the upper clamping plate 3422 when the electromagnetic valve 341 is operated and simultaneously adjust the gap between the driving wheel 311 and the auxiliary driving wheel 321 to enable the packing machine 20 to be adjusted for using packing straps with different thicknesses. Furthermore, the elastic element 3522 positioned at the rear end of the pawl 352 can be adjusted in its elastic force so that, when carrying out clamping, the pawl 352 can produce elastically clamping action to adjust the gap between the strapping wheel 312 and the auxiliary strapping wheel 331 for adjusting packing strength. Moreover, when the pawl 352 is working, the auxiliary elastic element 334 positioned between the strapping member 33 and the foundation plate 21 produces a reverse elastic action, and when the actuating pawl 352 finishes working, the auxiliary elastic element 334 will produce a reverse pulling force to move the strapping member 33 away from the main body 31.

As can be understood from the above description, this invention has the following advantages.

1. The main body, the driving member and strapping member are pivotally assembled together so they can be respectively disassembled for maintenance and repairs, saving cost and time in maintenance and elevating competitiveness of products.

2. During strap withdrawing, the light sensor of the strap withdrawal detecting mechanism can detect the rotating speed of the light disk (the rotating speed of the driving auxiliary wheel), letting time and process of strap withdrawal controlled by the strap withdrawal detecting member. Thus, the packing machine of this invention can desirably carry out strap withdrawing for different-sized articles being packed, able to heighten applicability and convenient in use.

While the preferred embodiment of the invention has been described above, it will be recognized and understood that various modifications may be made therein and the appended claims are intended to cover all such modifications that may fall within the spirit and scope of the invention.

I claim:

1. A strap feeding and withdrawing structure for a packing machine comprising:

a conveying device composed of a main body, a driving member, a strapping member, an electromagnetic switch unit, a pull member and a strap withdrawal detecting member;

said main body having one side provided thereon with a driving wheel and a strapping wheel, said main body transversely fixed with a combining member between said driving wheel and said strapping wheel, said combining member having its rear side extended backward to form an extension portion;

said driving member movably and pivotally disposed with an auxiliary driving wheel to be rotated together with said driving wheel of said main body, said driving member having one side pivotally assembled on said combining member of said main body, said driving member having one side, which is distant from said combining member, formed with a fastening portion;

said strapping member movably and pivotally provided thereon with an auxiliary strapping wheel to be rotated together with said strapping wheel of said main body, said strapping member having one side pivotally combined with said combining member of said main body, said strapping member having one side, which is distant from said combining member, formed with an interacting portion;

said electromagnetic switch unit composed of an electromagnetic valve and a connecting rod set, said connecting rod set having one end pivotally fixed with said fastening portion of said driving member, said connecting rod set having another end pivotally connected to said electromagnetic valve, said connecting rod set fitted with a shaft in its center, said connecting rod set actuated by said electromagnetic valve to turn, with said shaft acting as a pivot;

said pull member composed of a connecting rod and a pawl, said connecting rod pivotally combined with said extension member of said main body and able to be turned for a preset angle, said pawl secured at a rear end of said connecting rod, and said actuating pawl having its free ends pivotally combined with said interacting portion of said strapping member; and said strap withdrawal detecting member secured at one outer side of said driving member to be rotated together said auxiliary driving wheel, said strap withdrawal detecting member functioning to detect rotating conditions of said auxiliary driving wheel.

2. The strap feeding and withdrawing structure for a packing machine as claimed in claim 1, wherein a packing device is provided with an actuating cam for driving said connecting rod of said pull member to operate.

3. The strap feeding and withdrawing structure for a packing machine as claimed in claim 1, wherein said connecting rod set of said electromagnetic switch unit is composed of a lower clamping plate, an upper clamping plate and an elastic element, said lower clamping plate pivotally fixed on said electromagnetic valve, said upper clamping plate having one end pivotally fixed on said fastening portion of said driving member, said upper clamping plate firmly provided thereon with a shaft, said upper clamping plate having one side, which is distant from said fastening portion, elastically and pivotally fixed with said lower clamping plate by means of said elastic element.

4. The strap feeding and withdrawing structure for a packing machine as claimed in claim 1, wherein said combining member of said main body is U-shaped and has two free ends respectively bored with an insert hole, said driving member having its lower side bored with a lower insert hole, said strapping member having its topside bored with an upper insert hole, said insert holes of said combining member together with said lower insert hole and said upper insert hole aligned with one another for a pivot to be inserted and positioned therein.

5. The strap feeding and withdrawing structure for a packing machine as claimed in claim 1, wherein said strap withdrawal detecting member is composed of a light disk and a light sensor, said light disk having its circumference provided with light apertures preset in number, said light disk secured at an outer side of said driving member to be rotated together with said auxiliary driving wheel, said light sensor functioning to give out a signal to pass through said light disk for sensing action of said auxiliary driving wheel.

6. The strap feeding and withdrawing structure for a packing machine as claimed in claim 1, wherein said pawl of said pull member has its rear end extended backward to form an extension rod pivotally inserted through said connecting rod, and an elastic element is fitted on said extension rod to enable said pawl to be elastically and pivotally connected to said pull member, said strapping member provided thereon with an auxiliary elastic element corresponding to said elastic element of said extension rod and having a reverse action force.

* * * * *